US006887324B2

(12) United States Patent
Lee

(10) Patent No.: US 6,887,324 B2
(45) Date of Patent: May 3, 2005

(54) REFORMULATION OF COMPOSITION C-4 EXPLOSIVE

(75) Inventor: Kenneth E. Lee, North Ogden, UT (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 10/068,586

(22) Filed: Feb. 5, 2002

(65) Prior Publication Data

US 2003/0173008 A1 Sep. 18, 2003

Related U.S. Application Data

(60) Provisional application No. 60/267,962, filed on Feb. 9, 2001.

(51) Int. Cl.[7] ..... C06B 45/10; C06B 25/34

(52) U.S. Cl. ..... 149/19.2; 149/92

(58) Field of Search ..... 149/19.2, 92

(56) References Cited

U.S. PATENT DOCUMENTS

| | | | | |
|---|---|---|---|---|
| 2,999,744 A | | 9/1961 | Eckels | |
| 3,113,894 A | | 12/1963 | Burton | |
| 4,047,990 A | | 9/1977 | Falterman et al. | |
| 4,211,169 A | * | 7/1980 | Brothers | 102/494 |
| 4,293,351 A | | 10/1981 | Johannes | |
| 5,445,690 A | * | 8/1995 | Wulfman | 149/109.6 |
| 5,467,714 A | * | 11/1995 | Lund et al. | 102/284 |
| 5,529,649 A | * | 6/1996 | Lund et al. | 149/19.4 |
| 5,547,526 A | | 8/1996 | Wanninger et al. | |
| 5,587,553 A | * | 12/1996 | Braithwaite et al. | 149/19.1 |
| 5,690,868 A | * | 11/1997 | Strauss et al. | 149/19.91 |
| 5,716,557 A | * | 2/1998 | Strauss et al. | 149/19.6 |
| 5,750,921 A | * | 5/1998 | Chan et al. | 149/19.92 |
| 5,874,574 A | | 2/1999 | Johnston et al. | |
| 6,168,677 B1 | * | 1/2001 | Warren | 149/19.4 |
| 6,206,988 B1 | * | 3/2001 | Bazaki | 149/19.7 |
| 6,214,137 B1 | * | 4/2001 | Lee et al. | 149/19.7 |
| 6,391,130 B1 | * | 5/2002 | Sanderson et al. | 149/92 |

FOREIGN PATENT DOCUMENTS

| | | |
|---|---|---|
| DE | 20 27 709 A | 12/1971 |
| GB | 2326408 A | 12/1998 |
| WO | WO 00/52011 A2 | 9/2000 |

OTHER PUBLICATIONS

International Search Report, dated Nov. 18, 2002.

Chemical Abstracts, vol. 129, No. 10, Sep. 7, 1998, Braithwaite et al., "Development of High Performance CL–20 Explosive Formulations", p 788.

Kaully et al., "Paste Explosive Based on Rounded HMX: Rheology, Sensitivity, and Mechanical Properties," NDIA 2000 Insensitive Munitions and Energetic Materials Technology Symposium, Nov. 27–30, 2000, 120–130, San Antonio.

* cited by examiner

*Primary Examiner*—Aileen Felton
(74) *Attorney, Agent, or Firm*—TraskBritt

(57) ABSTRACT

A composition C4 substitute is provided, the substitute including 2,4,6,8,10,12-hexanitro-2,4,6,8,10,12-hexaazatetracyclo[5.5.0.0$^{5,9}$0$^{3,11}$]-dodecane (CL-20), optionally one or more nitramines other than CL-20, and silicone fluid. Also provided is an additive composition including CL-20 and bis(dinitropropyl)acetal and bis(dinitropropyl)formal (BDNPA/F). The additive composition is preferably combined with composition C-4.

8 Claims, 2 Drawing Sheets

REFORMULATION OF COMPOSITION C-4 EXPLOSIVE

RELATED APPLICATION

This application claims the benefit of priority of U.S. provisional application No. 60/267,962 filed in the U.S. Patent & Trademark Office on Feb. 9, 2001, the complete disclosure of which is incorporated herein by reference.

BACKGROUND OF THE INVENTION

1. Field of the Invention

This invention relates to the field of explosives and, in particular, is directed to compositions designed as substitutes for or additives in the current field explosive standard, composition C-4. This invention is also directed to a process for using the explosive compositions of this invention.

2. State of the Art

Nitramines are highly energetic compounds that have found wide acceptance in the art of explosives. Perhaps the most common nitramines in use in the explosives art today are 1,3,5-trinitro-1,3,5-triaza-cyclohexane (RDX) and 1,3,5,7-tetranitro-1,3,5,7-tetraaza-cyclooctane (HMX). RDX is well known for its use in composition CA, which is a combination of RDX, polyisobutylene, a plasticizer such as either dioctyladipate (DOA) or di(2-ethylhexyl)sebacate, and fuel oil. Composition C-4 has low impact sensitivity, is capable of being cut to desired sizes with relative ease, and can be directly adhered to a wide array of explosive sites. These properties make composition C-4 especially suitable for field operations.

There are, however, certain drawbacks to the use of composition C-4. Drawbacks of composition C-4 include its relatively low deformability at room temperature and its poor low temperature properties. For example, in field operations, composition C-4 cannot be readily forced into small holes. In a manufacturing environment, composition C-4 lacks the physical properties to permit its room-temperature injection through narrow passageways, such as an injection passageway or runner for a shaped-charge warhead. As a consequence, composition C-4 must be either heated to a sufficiently high temperature to increase its extrudability or cut to sufficiently small dimensions to permit its insertion into and through small spaces. Due to the hazardous and sometimes unforeseeable happenings that occur in field operation, it is often infeasible or impractical to heat composition C-4 to a sufficient temperature and for a sufficient period of time to lower its viscosity. Further, loading composition C-4 as a shaped charge into a warhead requires high compaction pressures in order to minimize the presence of voids between the warhead case and the composition C-4 charge. Even with precision loading, small voids still commonly remain.

U.S. Pat. No. 4,293,351 discloses a pliable and extrudable elastomeric explosive comprising either RDX or PETN (pentaerythritol tetranitrate) distributed in a pourable silicone rubber. Silicone oil will not accept large amounts of RDX at room temperature. Generally, up to about a 1:1 weight ratio of RDX to silicone fluid can be practiced. In order to permit loading of larger amounts of RDX in silicone, the patent teaches heating the silicone rubber to about 66° C. (150° F.). This high mix temperature complicates and prolongs processing. An acid catalyst is then added to the silicone rubber for curing. Because the silicone is cross-linked, recovery of the RDX from the cross-linked composition is difficult.

SUMMARY OF THE INVENTION

The present invention provides a reformulation of composition C-4 that possesses comparable or superior calculated energetic performance to composition C-4, but superior shapeability at room temperature compared to composition C-4.

The present invention also provides a method of loading the reformulated composition C-4 substitute through a relatively small orifice, runner, passageway, or the like into, for example, the case of an explosive device, such as a warhead.

The present invention further includes an additive composition that is compatible with composition C-4 and can be combined with composition C-4. Upon combination with composition C-4, the additive composition improves the shapeability of the composition C-4 without adversely affecting the calculated energetic performance properties of the composition C-4.

The present invention also provides a method of loading an explosive composition comprising composition C-4 and the additive composition through a relatively small orifice, runner, passageway, or the like into, for example, the case of an explosive device, such as a warhead.

The present invention relates to a composition C-4 substitute comprising 2,4,6,8,10,12-hexanitro-2,4,6,8,10,12-hexaazatetracyclo[5.5.0.0$^{5,9}$0$^{3,11}$]-dodecane (CL-20), optionally one or more nitramines other than CL-20, and silicone fluid is provided according to one aspect of the invention. Desirably, the CL-20 accounts for about 70 weight percent to about 90 weight percent of the total weight of the composition C-4 substitute, the silicone fluid accounts for about 10 weight percent to about 20 weight percent of the total weight of the composition C-4 substitute, and up to about 10 weight percent of the total weight of the composition C-4 substitute is the other nitramine or nitramines. It has been found that by practicing these preferred ranges, the silicone fluid may be present in an effective amount for establishing the composition as a paste at room temperature. The paste is easier to mold, inject, and push by hand through small orifices at room temperature than composition C-4, yet in preferred embodiments does not compromise explosive performance in comparison to composition C-4.

The present invention also relates to an additive composition that can be combined with composition C-4. In accordance with an aspect of this invention, the additive composition comprises 2,4,6,8,10,12-hexanitro-2,4,6,8,10,12-hexaazatetracyclo[5.5.0.0$^{5,9}$0$^{3,11}$]-dodecane (CL-20) and bis(dinitropropyl)acetal and bis(dinitropropyl)formal (BDNPA/F). The additive composition may be combined with composition C-4, which generally includes at least RDX and polyisobutylene, and may optionally include other ingredients commonly known in the art for their use in composition C-4, including plasticizers such as dioctyladipate (DOA), di(2-ethylhexyl)sebacate, dioctylsebacate, and fuel oils such as 10W-30. The additive composition of this invention can be formulated, upon combination with composition C-4, to improve the ability to shape composition C-4 without adversely affecting the calculated performance properties of composition C-4. Desirably, the total mass of the explosive composition—i.e., the combination of the composition C-4 and the additive composition—is made up of about 45 weight percent to about 69 weight percent RDX, about 0.5 weight percent to about 2.25 weight percent polyisobutylene, about 15 weight percent to about 30 weight percent CL-20, and about 15 weight percent to about 25 weight percent BDNPA/F, and optionally other ingredients.

The reformulated composition C-4 substitute and/or the modified composition (comprising composition C-4 and an additive composition) can be injected through a relative small orifice, runner, or passageway into the case of an explosive device, such as a warhead.

Additional advantages of the invention will be set forth in the description of the preferred embodiments and methods that follows and, in part, will be apparent from the description, or may be learned by practice of the invention. The objects and advantages of the invention may be realized and obtained by means of the instrumentalities and combinations pointed out in the appended claims.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

DETAILED DESCRIPTION OF PREFERRED EMBODIMENTS AND METHODS OF THE INVENTION

Figure 1:
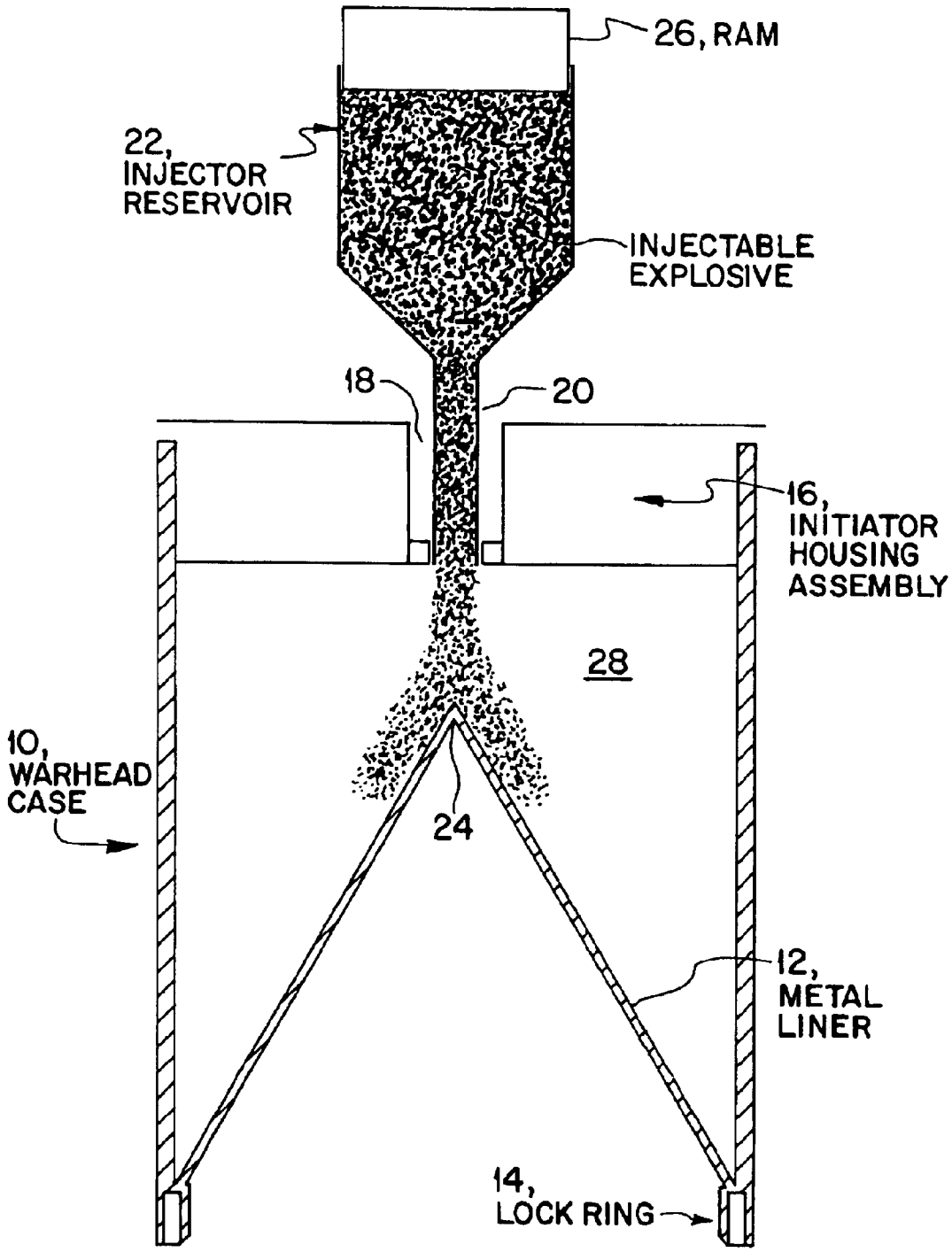
FIG. 1 illustrates in schematic view an apparatus suitable for carrying out a presently preferred embodiment of a method of the invention.

Reference will now be made in detail to the presently preferred embodiments and methods of the invention as described below. It should be noted, however, that the invention in its broader aspects is not limited to the specific details, representative devices and methods, and examples described in this section in connection with the preferred embodiments and methods. The invention according to its various aspects is particularly pointed out and distinctly claimed in the attached claims read in view of this specification and appropriate equivalents.

It is to be noted that, as used in the specification and the appended claims, the singular forms "a," "an," and "the" include plural referents unless the context clearly dictates otherwise. Thus, by way of example, the term "nitramine" includes in its definition a combination of two or more nitramine compounds, for example. Similarly, as another example, the term "composition" may include a combination of two or more compositions.

In accordance with one preferred embodiment of this invention, an explosive composition is provided that comprises about 70 weight percent to about 90 weight percent 2,4,6,8,10,12-hexanitro-2,4,6,8,10,12-hexaazatetracyclo [5.5.0.0$^{5,9}$0$^{3,11}$]-dodecane (CL-20), 0 weight percent to about 10 weight percent of at least one nitramine other than the CL-20, and about 10 weight percent to about 20 weight percent of at least one silicone fluid.

The production of CL-20 is well known in the art and is described in various publications, including WO 00/52011. U.S. Pat. No. 5,874,574 teaches the crystallization of CL-20 into its epsilon polymorph. In the context of preferred embodiments of this invention, epsilon-polymorph CL-20 is selected, although the presence of small and expected amounts of impurities (e.g., other CL-20 polymorphs) are acceptable and within the scope of the preferred embodiments of the invention. It is more preferred to select the CL-20 concentration at 70 weight percent to 80 weight percent of the total composition weight.

Although the incorporation of other nitramines into the explosive composition is optional, it is desirable that the nitramine account for 1 weight percent to 10 weight percent of the total composition weight. Still more desirably, nitramines other than CL-20 account for 5 weight percent to 10 weight percent of the total composition weight. Exemplary nitramines that can be used for this invention include, by way of example, 1,3,5-trinitro-1,3,5-triaza-cyclohexane (RDX), 1,3,5,7-tetranitro-1,3,5,7-tetraaza-cyclooctane (HMX), and 4,10-dinitro-2,6,8,12-tetraoxa-4,10-diazatetracyclo-[5.5.0.0$^{5,9}$0$^{3,11}$]-dodecane (TEX). Of these, 1,3,5,7-tetranitro-1,3,5,7-tetraaza-cyclooctane (HMX) is most desirable.

The CL-20 concentration, other nitramine concentration, and total nitramine concentration are desirably selected to provide the explosive composition with energetic properties that at least match, and preferably exceed, those of composition C-4. Thus, in one embodiment, the explosive composition is formulated to have a calculated detonation pressure of 246 kbar or higher and a cylinder expansion energy of 6.92 kJ/cc or higher. Detonation pressure is sometimes used to indicate the ability of the explosive to drive inert material, such as shrapnel or earth. Detonation pressure may be calculated based on the software CHEETAH, available through Lawrence Livermore National Laboratory of Livermore, Calif. This software is well known and used in the art, including by those having ordinary skill in the art of explosive development. Cylinder expansion energy is often used to designate the measure of the energy transferred from an explosive to metal during detonation, and is determined by measuring the deformation to an oxygen-free copper tube caused by explosion of a sample within the copper tube. Cylinder expansion ratio testing is routinely performed at U.S. Army Picatinny Arsenal in New Jersey, U.S.A.

The use of silicone fluid in the preferred range of about 10 weight percent to about 20 weight percent affects the physical properties of the composition, forming a paste that may be subject to injection processes. Silicone fluids generally have structures with one or more of the following repeating units

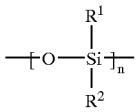

wherein $R^1$ and $R^2$ are the same or different and are selected from the group consisting of hydrogen; alkyls (e.g., methyl, ethyl, propyl, isopropyl); aryls (e.g., phenyl and substituted phenyl compounds); alkenyls (e.g., vinyl), and the like. If the silicone fluid has the same repeating unit forming its chain, the silicone is referred to as a homopolymer, as that term is commonly used in the art. If the silicone fluid includes two or more different repeating units, it is referred to as a copolymer, as that term is commonly used in the art. As the term is referred to herein, copolymers encompass terpolymers and other polymers composed of three or more different monomeric units. The explosive composition may include one or more homopolymers, one or more copolymers, or a combination of homopolymers and copolymers. Representative homopolymers that may be used include those selected from the group consisting of dimethylsiloxane (—O—Si$(CH_3)_2$—), methylphenylsiloxane (—O—Si($CH_3$)($C_6H_5$)—), polysilane (—O—Si($H$)$_2$—), methylvinylsiloxane (—O—Si($CH_3$)($CH_2$=$CH_2$)—), and diphenylsiloxane (—O—Si($C_6H_5$)$_2$—). Representative copolymers that may be used include those comprising repeating units of two or more members selected from the group consisting of dimethylsiloxane, methylphenylsiloxane, polysilane, methylvinylsiloxane, and diphenylsiloxane.

The symbol "n" represents the number of repeating units, and is desirably selected to provide the silicone fluid with a room temperature viscosity in the range of about 350 centistokes to about 5000 centistokes.

One of the advantages that may be bestowed upon the composition by the silicone fluid is a relatively low softening point. The low softening point of the plastic explosive compositions of the embodiments of this invention makes the compositions highly shapeable into a charge for a variety of explosive applications, such as demolition, cutting, and breaching applications.

As referred to herein, the term "softening point" is measured by the following procedure:

1. Provide a Perkin-Elmer TMA/DMA7 thermomechanical analyzer fitted with a 3 mm hemispherical penetration probe and liquid nitrogen cooling accessory, and zero the height of the probe to an empty stainless steel sample cup (7.2 mm diameter, 2.1 mm depth).
2. Weigh the empty cup.
3. Pack the cup with a sample material so that the sample material is level with the top of the cup.
4. Reweigh the cup to determine the sample material weight.
5. Place the cup with the sample onto a sample holder and cool to −130° C.
6. After equilibration at this temperature, lower the probe onto the sample and apply a load of 500 or 2000 mN (milliNewton).
7. Allow the probe position to equilibrate and record the height of the sample.
8. Heat the sample to 110° C. at 5° C./min, recording the probe height as a function of temperature.
9. Plot the sample temperature (on the abscissa) versus the percent of the probe height (on the ordinate) penetrated into the sample. Report the softening temperature from the intersection point of tangent lines drawn after the transition and from the steepest slope of the transition.

Desirably, the softening point of the reformulated composition C-4 substitute is not greater than 0° C., more desirably not greater than −20° C.

The use of silicone fluid may confer additional advantages. For example, many silicone fluids are capable of being dissolved with environmentally friendly solvents, such as short-chain hydrocarbon or cyclo-hydrocarbon, including pentane, heptane, and hexane.

Processing of the composition C-4 substitute will now be described in more detail. In accordance with one aspect of the invention, the explosive composition may be formulated by mixing the ingredients in a conventional mixture, such as a Hobart Planetary Mixer or a Sigma-Blade Mixer. The ingredients may be mixed in any order, although it is preferred to add the energetic solids to the silicone fluid. Mixing may be performed by hand. Room temperature and pressure are suitable for mixing. Advantageously, there is no waste stream produced by this embodiment.

In accordance with another embodiment of this invention, an additive composition is provided that may be combined with composition C-4 to provided a modified composition with improved physical properties over composition C-4 and, in particular, lower softening points than composition C-4. In this preferred embodiment, the additive composition comprises 2,4,6,8,10,12-hexanitro-2,4,6,8,10,12-hexaazatetracyclo[5.5.0.0$^{5,9}$0$^{3,11}$]-dodecane (CL-20) and bis(dinitropropyl)acetal and bis(dinitropropyl)formal (BDNPA/F). The weight ratio of the composition C-4 to the additive composition is desirably in a range of 1:1 to 3:1.

As referred to in the context of this preferred embodiment and generally understood in the art, composition C-4 comprises about 90 weight percent to about 92 weight percent RDX and about 1 weight percent to about 3 weight percent polyisobutylene.

The CL-20 for this embodiment may be prepared in accordance with the techniques described above and desirably is epsilon-polymorph. It is desirable that the CL-20 account for about 15 weight percent to about 30 weight percent of the total weight of the explosive composition—i.e., the composition C-4 and the additive composition. It is still more desirable that 15 weight percent to 20 weight percent of the total weight of the explosive composition consist of CL-20. The BDNPA/F desirably accounts for about 15 weight percent to about 25 weight percent, more desirably 15 weight percent to 19 weight percent, of the total weight of the explosive composition.

The additive composition may also comprise at least one binder swellable in the BDNPA/F and at least one silicone fluid. The silicone fluids mentioned above are suitable for this embodiment. The binder desirably comprises at least one member selected from the group consisting of cellulose esters, polyethers, and polyurethanes. Desirably, the binder comprises cellulose acetate butyrate. A suitable range for binder concentration is, by way of example, 0.5 to 1.5 weight percent.

An explosive composition comprising composition C-4 and the additive composition preferably has a calculated detonation pressure of 246 kbar or higher, a cylinder expansion energy of 6.92 kJ/cc or higher, and a softening temperature of not greater than 0° C., more preferably not greater than −20° C. Techniques for measuring and calculating these properties are set forth above.

Set forth in the table below are calculated performance properties of inventive formulations of this invention and, for comparative purposes, composition C-4. The composition C-4 used in these examples and comparative example consisted of 91 weight percent RDX, 5.3 weight percent DOS or DOA, 2.1 weight percent polyisobutylene, and 1.6 weight percent process oil.

| | Composition 1 | Composition 2 | Composition C-4 |
|---|---|---|---|
| Ingredient | | | |
| CL-20 | 49 | 52 | — |
| BDNPA/F | 51 | 43 | — |
| CAB | — | 2 | — |
| PMPS | — | 3 | — |
| Ratio C-4 to Additive | 2:1 | 1:1 | — |
| Calculated Performance | | | |
| TMD (99%, g/cc) | 1.63 | 1.62 | 1.64 |
| $P_{CJ}$ (kbar) | 255 | 247 | 246 |
| Detonation Velocity (km/s) | 7.89 | 7.80 | 7.80 |
| Temperature K | 4242 | 4243 | 3836 |
| Cylinder Expansion Energy (@$V/V_o$ = 6.5 kJ/cc) | 7.21 | 7.10 | 6.92 |
| Total Energy (kJ/cc) | 8.95 | 8.97 | 8.79 |

As seen from this table, the calculated performance properties of the inventive compositions are at least comparable, and in most cases superior, to those of composition C-4.

It is possible to lower the viscosity of the explosive compositions of this invention by slurrying the compositions in a suitable liquid, such as heptane.

A method of loading a warhead case with the explosive composition of the various embodiments of this invention will not be described in greater detail with reference to FIG. 1.

As shown in FIG. 1, a cylindrical metal warhead case 10 is fitted with a conical metal liner 12. A lock ring 14 secures the conical metal liner 12 to the warhead case 10. Facing the metal liner 12 is an initiator housing assembly 16 having an inner edge defining an initiator orifice 18. Prior to installment of the initiator (not shown), a runner 20 of injector reservoir 22 is directed into the initiator orifice 18 to oppose apex 24 of the metal liner 12. In the illustrated embodiment, a ram 26 is used to force explosive composition into chamber 28. Although not shown, sprue holes may be provided, for example, between the runner 20 and the inner edge of the initiator housing assembly 16. Because of the relatively low viscosity of the explosive compositions of the embodiments of this invention, the explosive composition may be injected through the runner 20 or other conventional passageway into a warhead case for facilitating warhead production.

The following examples serve to explain embodiments of the invention in more detail. These examples are not to be construed as being exhaustive or exclusive as to the scope of this invention.

EXAMPLES

Example 1

80 parts by weight of 2 micron ground CL-20 were combined with 20 parts by weight of 5000 cps polydimethylsilicone fluid at room temperature (25° C.) and mixed until smooth.

Example 2

75 parts by weight of 2 micron ground CL-20 and 5 parts by weight of 2 micron ground HMX were combined with 20 parts by weight of 5000 cps polydimethylsilicone fluid at room temperature (25° C.) and mixed until smooth.

Example 3

70 parts by weight of 2 micron ground CL-20 and 10 parts by weight of 2 micron ground HMX were combined with 20 parts by weight of 5000 cps polydimethylsilicone fluid at room temperature (25° C.) and mixed until smooth.

Figure 2:
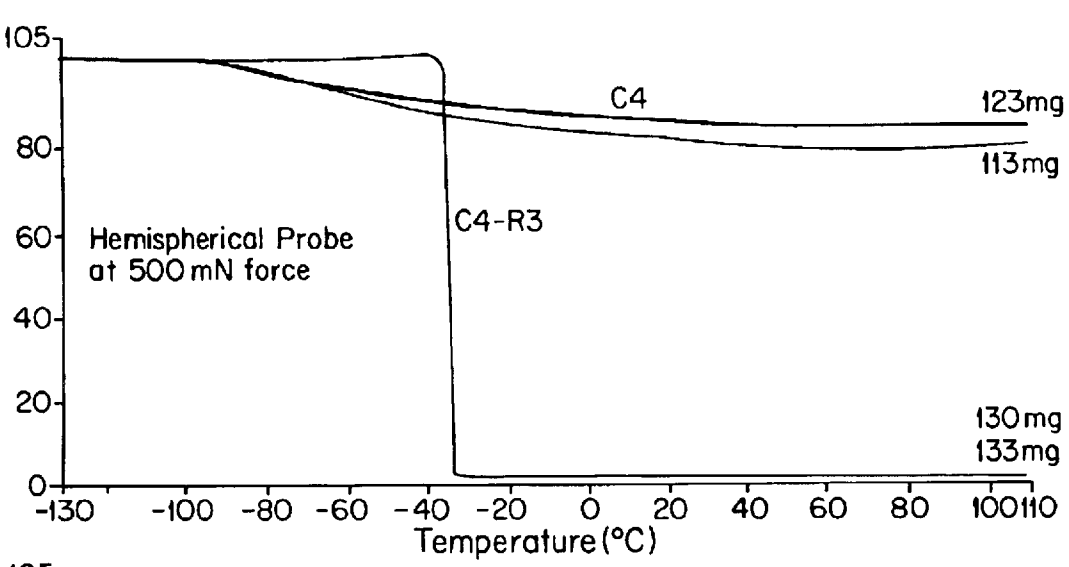
FIG. 2 is a graph in which the softening temperatures of inventive Example 3 and samples of composition C-4 are compared.
Figure 3:
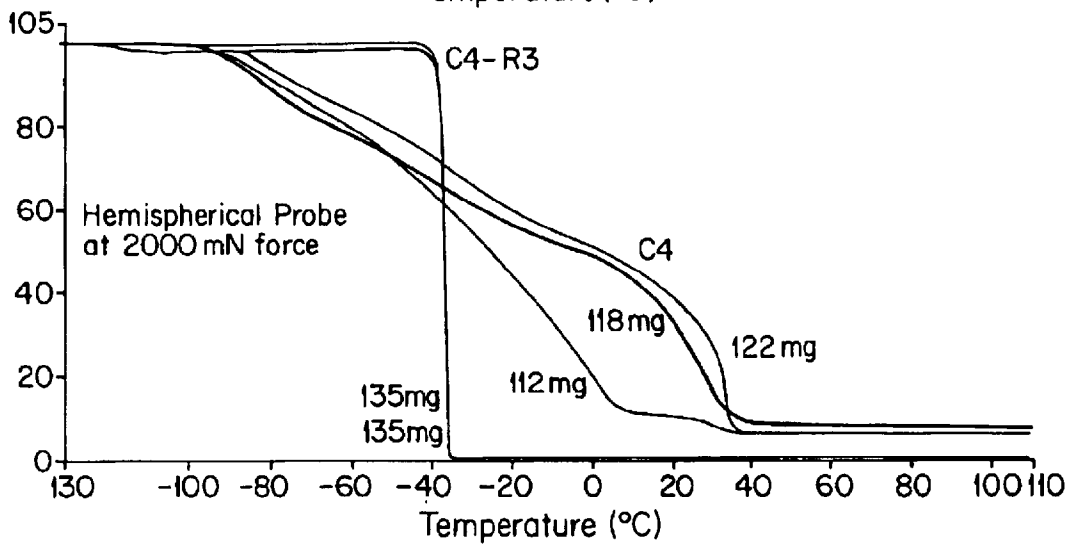
FIG. 3 is another graph in which the softening temperatures of inventive Example 3 and samples of composition C-4 are compared.

The softening point of the resulting explosive composition was measured by a probe force of 500 mN (FIG. 2) and 2000 mN (FIG. 3). Sample sizes of 130 mg and 133 mg were used in FIG. 2, and sample sizes of 135 mg were used in FIG. 3. As shown in FIGS. 2 and 3, Example 3 had a softening point of about −38° C. at both probe forces.

FIG. 2 also shows the plot for a 113 mg sample and a 123 mg sample of composition C-4. As seen by these plots, composition C-4 had a much greater softening temperature than Example 3 and did not soften sufficiently to allow full penetration of the probe. As shown in FIG. 3, the 112 mg, 118 mg, and 122 mg samples of composition C-4 subjected to a 2000 mN probe force produced similar results—i.e., a higher softening point and less penetration compared to Example 3.

Example 4

15.93 parts by weight of 2 micron ground CL-20 were combined with 16.50 parts by weight of BDNPA/F at room temperature (25° C.) and mixed thoroughly. The mixture was then combined with 67.57 parts by weight of composition C-4 and mixed until smooth.

Example 5

One part by weight of CAB was dissolved in BDNPA/F and heated at 66° C. (150° F.) for 3 hours. Twenty-four hours later, 26 parts by weight of 2 micron ground CL-20 and the CAB-BDNPA/F were combined at room temperature (25° C.) and mixed thoroughly. 1.5 parts by weight of polymethylphenylsilicone fluid (350–550 cps) was added and mixed until smooth. Fifty parts by weight of composition C-4 were then added and mixed until smooth.

The foregoing detailed description of the preferred embodiments of the invention has been provided for the purposes of illustration and description, and is not intended to be exhaustive or to limit the invention to the precise embodiments disclosed. The embodiments were chosen and described in order to best explain the principles of the invention and its practical application, thereby enabling others skilled in the art to understand the invention for various embodiments and with various modifications as are suited to the particular use contemplated. It is intended that the scope of the invention cover various modifications and equivalents included within the spirit and scope of the appended claims.

What is claimed is:

1. An explosive composition, comprising:

about 45 weight percent to about 69 weight percent 1,3,5-trinitro-1,3,5-triaza-cyclohexane (RDX) based on a total weight of the explosive composition;

about 0.5 weight percent to about 2.25 weight percent polyisobutylene based on the total weight of the explosive composition;

about 15 weight percent to about 30 weight percent 2,4,6,8,10,12-hexanitro-2,4,6,8,10,12-hexaazatetracyclo[5.5.0.0$^{5,9}$0$^{3,11}$]-dodecane (CL-20) based on the total weight of the explosive composition; about 15 weight percent to about 25 weight percent bis(dinitropropyl)acetal and bis(dinitropropyl)formal (BDNPA/F) based on the total weight of the explosive composition;

at least one binder swellable in the BDNPA/F; and at least one silicone fluid.

2. The explosive composition of claim 1, wherein the CL-20 comprises 15 weight percent to 20 weight percent of the total weight of the explosive composition, and wherein the BDNPA/F comprises 15 weight percent to 19 weight percent of the total weight of the explosive composition.

3. The explosive composition of claim 1, wherein a weight ratio of the RDX and the polyisobutylene to the CL-20 and the BDNPA/F is in a range of 1:1 to 3:1.

4. The explosive composition of claim 1, wherein the at least one binder comprises at least one member selected from the group consisting of cellulose esters, polyethers, and polyurethanes.

5. The explosive composition of claim 1, wherein the at least one binder comprises cellulose acetate butyrate.

6. The explosive composition of claim 1, wherein the at least one silicone fluid comprises at least one homopolymer selected from the group consisting of dimethylsiloxane, methylphenylsiloxane, polysilane, methylvinylsiloxane, and diphenylsiloxane.

7. The explosive composition of claim 1, wherein the at least one silicone fluid comprises at least one copolymer comprising repeating units of at least two members selected from the group consisting of dimethylsiloxane, methylphenylsiloxane, polysilane, methylvinylsiloxane, and diphenylsiloxane.

8. The explosive composition of claim 1, wherein the at least one silicone fluid has a room temperature viscosity in a range of about 350 centistokes to about 5000 centistokes.

* * * * *